US006930442B2

(12) United States Patent
Awamoto et al.

(10) Patent No.: US 6,930,442 B2
(45) Date of Patent: Aug. 16, 2005

(54) DISPLAY DEVICE

(75) Inventors: Kenji Awamoto, Kawasaki (JP); Tsutae Shinoda, Kawasaki (JP); Akira Tokai, Kawasaki (JP); Hitoshi Yamada, Kawasaki (JP); Manabu Ishimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 225 days.

(21) Appl. No.: 10/314,280

(22) Filed: Dec. 9, 2002

(65) Prior Publication Data

US 2003/0214224 A1 Nov. 20, 2003

(30) Foreign Application Priority Data

May 14, 2002 (JP) ..... 2002-138699

(51) Int. Cl.[7] ..... H01J 5/50

(52) U.S. Cl. ..... 313/51; 313/49; 313/318.12; 313/331

(58) Field of Search ..... 313/49, 50, 51, 313/623, 238, 318.12, 244, 594, 243, 283, 284, 291, 331; 439/59, 62

(56) References Cited

U.S. PATENT DOCUMENTS 6,034,470 A * 3/2000 Vollkommer et al. ..... 313/485
6,674,250 B2 * 1/2004 Cho et al. ..... 315/291

* cited by examiner

*Primary Examiner*—Joseph Williams
*Assistant Examiner*—Sharlene Leurig
(74) *Attorney, Agent, or Firm*—Staas & Halsey LLP

(57) ABSTRACT

A display device includes a plurality of emitting tubes constituted by elongated tubes each having a phosphor layer disposed and a discharge gas enclosed inside, a supporter for supporting the plurality of emitting tubes while making contact therewith, and a plurality of electrodes disposed on a surface of the supporter facing the emitting tubes for generation of electric discharges within the emitting tubes. The supporter has a connecting portion at an edge. The connecting portion of the supporter is detachably connected to a connector for applying a voltage to the plurality of electrodes.

16 Claims, 12 Drawing Sheets

DISPLAY DEVICE

CROSS-REFERENCE TO RELATED APPLICATION

This application is related to Japanese application No. 2002-138699 filed on May 14, 2002, whose priority is claimed under 35 USC § 119, the disclosure of which is incorporated by reference in its entirety.

BACKGROUND OF THE INVENTION

1. Field of the Invention

The present invention relates to a display device. More particularly, it relates to a display device in which a plurality of emitting tubes (also referred to as "plasma emitting tubes", "display tubes", "gas discharge tubes" and the like), constituted by elongated tubes of a diameter of about 0.5 to 5 mm each having a phosphor layer disposed and a discharge gas enclosed inside, are arranged parallel to each other for displaying desired images through application of a voltage to electrodes formed outside the tubes.

2. Description of Related Art

In general, PDPs (plasma display panels) are so constructed that a pair of substrates each having electrodes formed thereon are disposed opposite to each other with a periphery thereof sealed and a discharge gas enclosed in a discharge space defined between the substrate pair. For application of a voltage to the electrodes, the electrodes are formed to extend to edges of the substrates, flexible wiring cables are crimped onto the electrodes at edges thereof, and the wiring cables are provided at tops thereof with connectors, followed by connecting the connectors to terminals of drivers.

In recent years, display devices have been known having a plurality of emitting tubes arranged parallel to each other and displaying desired images through application of a voltage to electrodes formed outside the tubes. A display device of this type wherein a number of emitting tubes are arranged parallel to each other is capable of having a screen as large as meters×meters with electrodes formed on a substrate of meters large dimensions. Accordingly, there has been a demand for an effective method for connecting the electrodes and drivers.

SUMMARY OF THE INVENTION

The present invention has been made in view of the above circumstances and the main purpose thereof is to facilitate the connection between the electrodes and the drivers by forming the electrodes on a supporter for supporting a plurality of emitting tubes and forming at an edge of the supporter a connector-connecting portion for applying a voltage to the electrodes.

The present invention provides a display device comprising: a plurality of emitting tubes constituted by elongated tubes each having a phosphor layer disposed and a discharge gas enclosed inside; a supporter for supporting the plurality of emitting tubes while making contact therewith, the supporter having a connecting portion at an edge; and a plurality of electrodes disposed on a surface of the supporter facing the emitting tubes for generation of electric discharges within the emitting tubes, wherein the connecting portion of the supporter is detachably connected to a connector for applying a voltage to the plurality of electrodes.

According to the present invention, the supporter for supporting the emitting tubes has at the edge the connecting portion to be detachably connected to the connector for applying the voltage to the plurality of electrodes, so that it becomes possible to eliminate the need for using conventional wiring cables to facilitate connection between the electrodes and the drivers, with a result that connection costs can be reduced.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
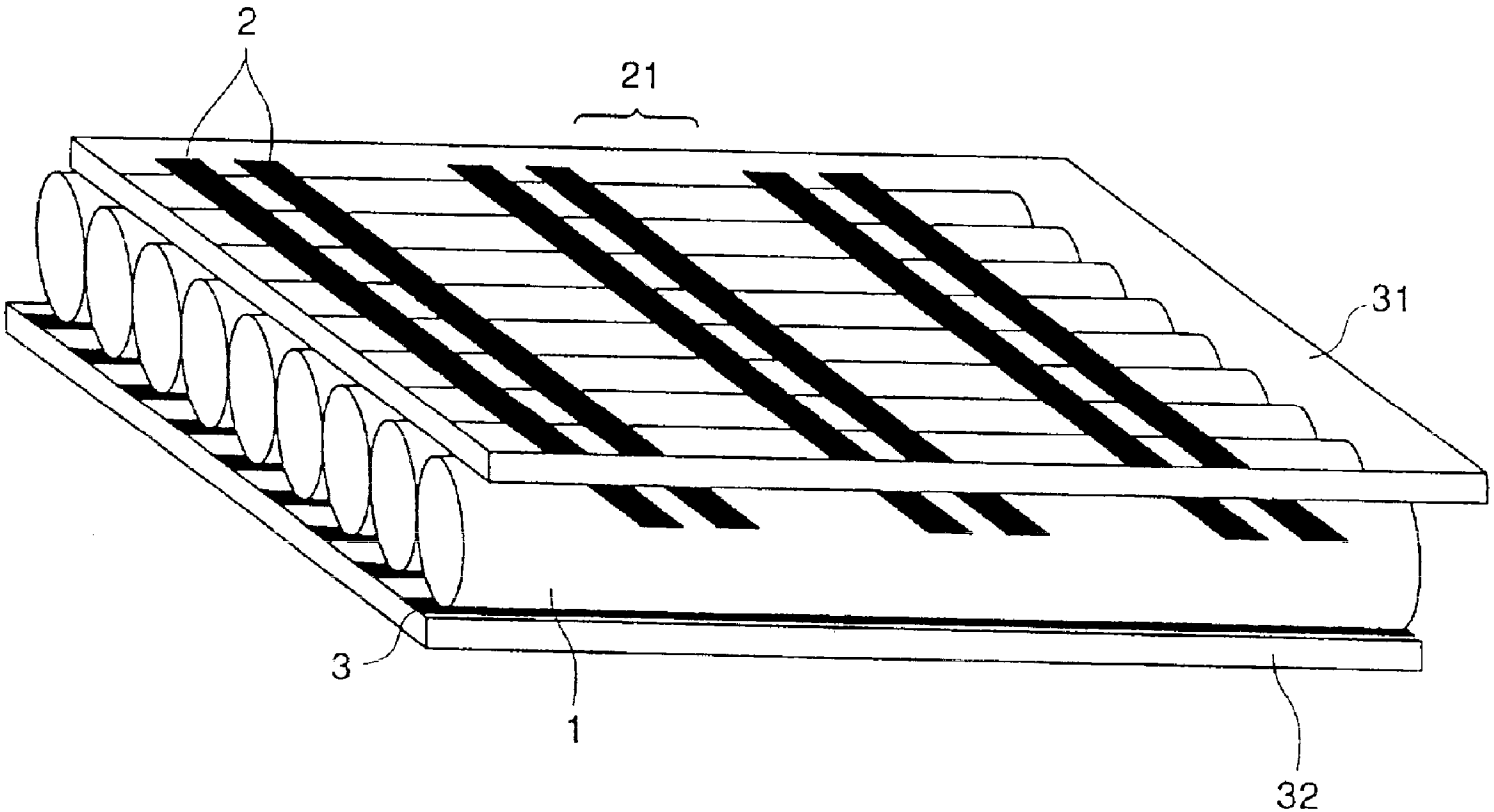
FIG. 1 is an explanatory view illustrating the general construction of a display device according to the present invention.

In the present invention, the emitting tubes can be any if they are constituted by elongated tubes each having a phosphor layer disposed and a discharge gas enclosed inside. As the emitting tube, may be used various emitting tubes known in the art. An elongated tube of any diameter may be used, but especially one of a diameter of 0.5 to 5 mm is preferred for the emitting tube. The elongated tube may have a circular cross section or a flat elliptic cross section.

The supporter can be any if it is capable of supporting the plurality of supporting the emitting tubes while in contact therewith. As the supporter, may be used one made of glass, synthetic resin or the like. Desirably, the supporter is composed of a pair of supporters for supporting the plurality of emitting tubes on a display side and on a rear side of the display device. Further, it is desirable that either supporter of the supporter pair is formed of a flexible film sheet.

The electrodes may be any if they are disposed on the surface of the supporter facing the emitting tubes for generation of electric discharges within the emitting tubes through application of the voltage to the emitting tubes. The electrodes are capable of being formed on the surface facing the emitting tubes by a method known in the art. The electrodes may be formed on the surface facing the emitting tubes by depositing or printing copper, chromium, silver or the like.

In the present invention, the supporter has at the edge the connecting portion to be detachably connected to the connector for applying the voltage to the plurality of the electrodes. The connector for applying the voltage to the plurality of the electrodes means a connector connected to a driver (drive circuit) for example.

Desirably, the connecting portion is formed into a plug to be inserted into the connector. Where the connecting portion is divided into a plurality of sections, a plurality of drivers of one kind having a predetermined size can be used, so that the constitution of the display device can be easily adapted to screen size changes. Also, reductions in cost of the drivers can be achieved.

The supporter on the display side may be divided into a plurality of pieces that have at edges a plurality of connecting portions, respectively.

Where the connecting portion is divided into the plurality of sections, or the supporter itself is divided into the plurality of pieces that have at the edges the plurality of connecting portions, respectively, it is desirable that the connector is composed of a plurality of connectors corresponding to the divided connecting portion that is connected to the drive circuits for applying the voltage to the plurality of electrodes.

Desirably, the divided connecting portion is gently curved to be connected to the plurality of connectors.

The present invention will now be explained in detail based on the preferred embodiment shown in the drawings. It should be understood that the present invention is not limited to the embodiment.

FIG. 1 is an explanatory view illustrating the general construction of a display device according to the present invention with electric circuits omitted.

In the display device according to the present invention, a plurality of emitting tubes, constituted by elongated tubes of a diameter of about 0.5 to 5 mm each having a phosphor layer disposed and a discharge gas enclosed inside, are arranged parallel to each other for displaying desired images by generation of electric discharges through application of a voltage to electrodes formed outside the tubes.

In the drawing, reference numeral 31 indicates a front substrate (substrate on a display side), 32 a rear substrate, 1 emitting tubes, 2 display electrode pairs (main electrode pairs), and 3 data electrodes (signal electrodes).

The front substrate 31 is formed of a flexible transparent film sheet. As this film, may be used a commercially available polycarbonate film, PET (polyethylene terephthalate) film or the like. The rear substrate 32 is formed of an acryl-based resin. A tube body of the emitting tube 1 is formed of a borosilicate glass. The display electrode pairs 2 are formed on a surface of the front substrate 31 facing the tubes by depositing or printing ITO, copper, chromium, silver or the like. The data electrodes 3 are formed on a surface of the rear substrate 32 facing the tubes by depositing and printing copper, chromium, silver or the like.

Inside the tube 1 (within a discharge space), a phosphor layer (not shown) is formed, a discharge gas is introduced, and both ends of the tube are sealed. The data electrodes 3 are formed on the rear substrate 32 as mentioned above so as to come into contact with the tubes 1 in a longitudinal direction thereof. The display electrode pairs 2 are formed on the front substrate 31 so as to come into contact with the tubes 1 in a direction crossing the date electrodes 3. Non-discharge regions (non-discharge gaps) 21 are provided between adjacent display electrode pairs 2.

In assembly of the display device, the data electrodes 3 and the display electrode pairs 2 are closely contacted with an outer periphery of the tube 1 on lower and upper sides, respectively. An adhesive may be interposed between the display electrode 2 and the outer periphery of the tube 1 on the upper side to improve the contact therebetween.

Figure 2:
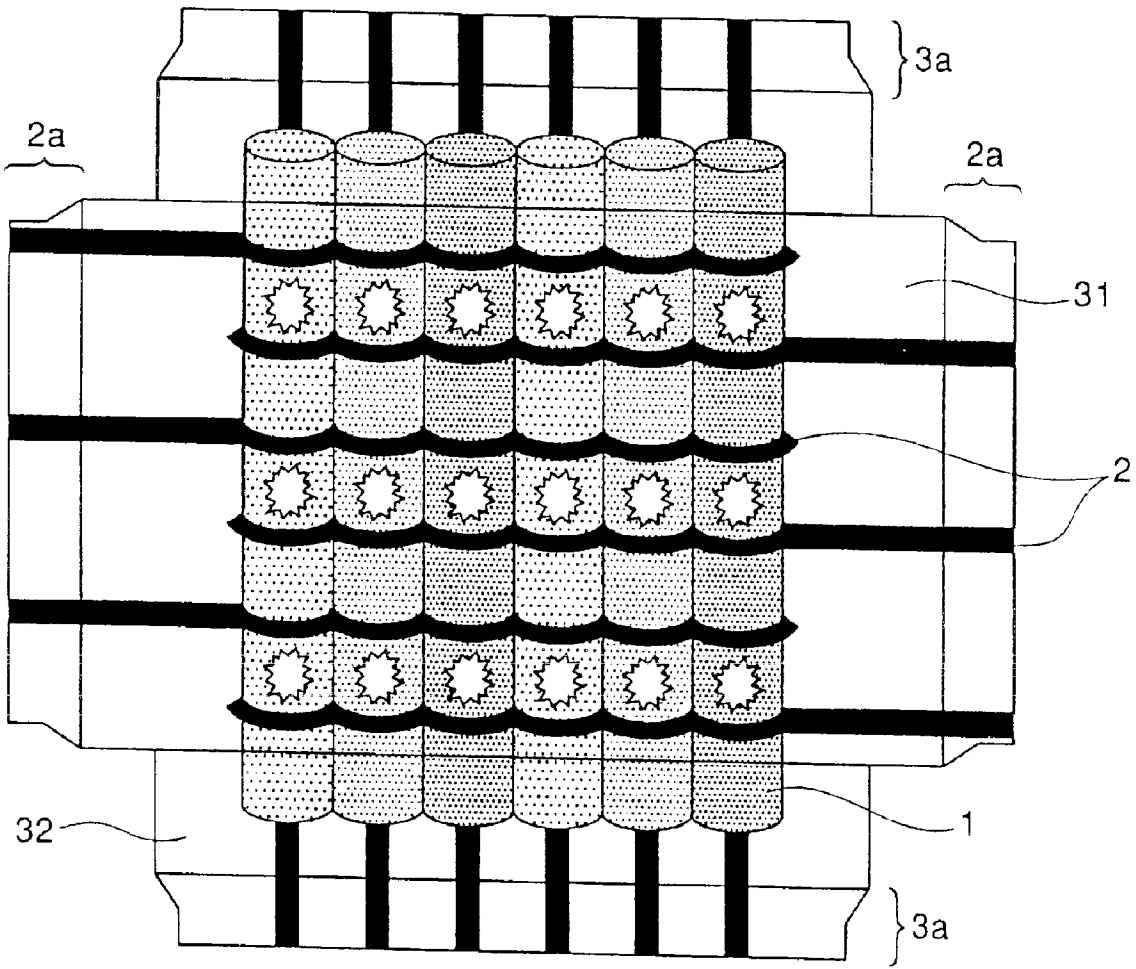
FIG. 2 is an explanatory view illustrating the display device as an embodiment viewed in plan.

FIG. 2 is an explanatory view illustrating the display device viewed in plan.

Sets of three tubes 1 for three colors of R (red), G (green) and B (blue) are sequentially arranged parallel.

An area where the data electrode 3 intersects the display electrode pair 2 is a unit luminous area, when the display device is viewed in plan. Display is performed as follows. Using, as a scanning electrode, either one electrode of the display electrode pair 2, a selection discharge is generated at the area where the scanning electrode intersects the signal electrode 3 so as to select a luminous area. Utilizing, simultaneously with emission of light, a wall charge provided within the tube in the luminous area, display discharges are generated between the display electrode pair 2. A selection discharge is an opposite discharge generated within the tube 1 between the scanning electrode and the data electrode 3 opposed to each other in a vertical direction. A display discharge is a surface discharge generated within the tube 1 between the display electrode pair 2 disposed parallel to each other on a plane.

Due to these electrode arrangements, a plurality of emission points are formed longitudinally of the tube 1.

Connector-connecting portions 2*a* for the display electrode pairs 2 are provided at right and left edges of the front substrate 31. Connector-connecting portions 3*a* for the data electrodes are provided at top and bottom edges of the rear substrate 32.

In FIG. 2, three electrodes are arranged at one luminous area so that display discharges are generated between the display electrode pair 2, but the manner of generating display discharges is not limited thereto, and display discharges may be generated between the display electrode 2 and the data electrode 3.

In other words, such a construction may be designed that the display electrode pair 2 is used as one electrode and the display electrode 2 thus obtained is used a scanning electrode, so that selection discharges and display discharges (opposite discharges) are generated between the display electrode 2 and the data electrode 3.

Figure 3:
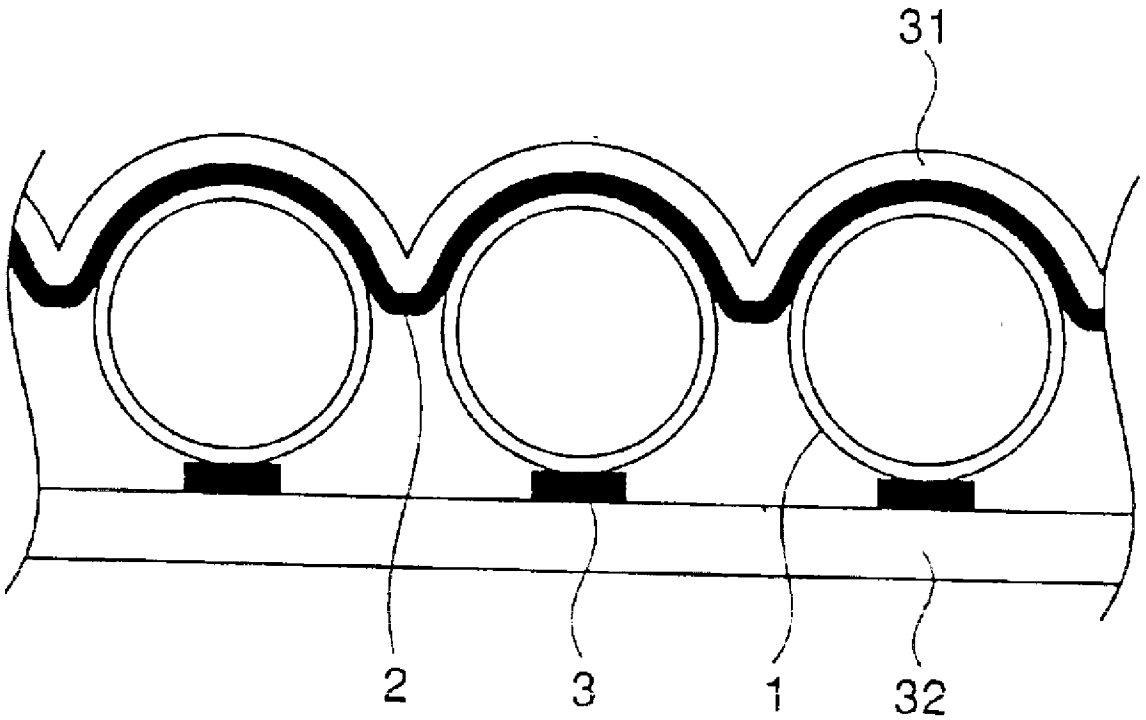
FIG. 3 is an explanatory view illustrating a cross section of the display device as an embodiment.

FIG. 3 is an explanatory view illustrating a cross section of the display device that is orthogonal with respect to the longitudinal direction of the tubes.

The emitting tube 1, having a circular cross section, is made of Pyrex (registered trademark; a heat-resisting glass manufactured by Corning Inc. U.S.A.) or the like to have an external diameter of 1 mm; a material thickness of 100 $\mu$m and a length of 400 mm.

A glass tube constituting the tube body of the tube 1 is obtained by producing a base material similar to and larger than the tube 1 by Danner Process and extending the base material while softening it by heating.

Since the front substrate 31 is made of a flexible transparent film sheet as mentioned above, the display electrode pairs 2 come into sufficient contact with the tubes 1 along the surfaces of the tubes 1. Thus, a sufficient effective area can be ensured for the discharging electrodes, resulting in improved display luminance of the displace device.

An unillustrated electric circuit for driving the tubes 1 is provided on a surface of the rear substrate 32 opposite to the tube-facing surface, that is, an outer surface of the rear substrate 32.

Figure 4:
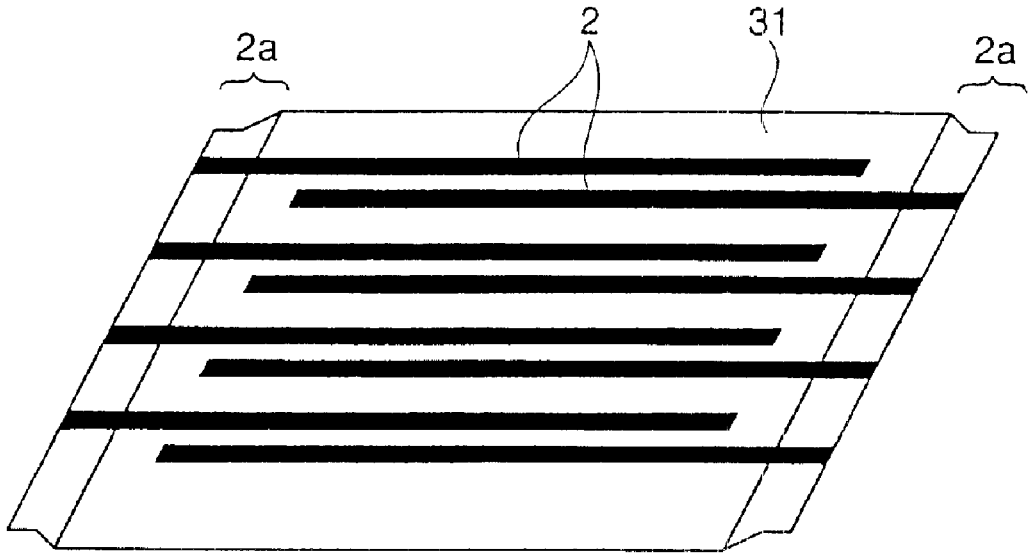
FIGS. 4(*a*) and 4(*b*) are explanatory views illustrating an electrode structure on the front substrate 31 and one on the rear substrate 32 of the display device as an embodiment.
Figure 4:
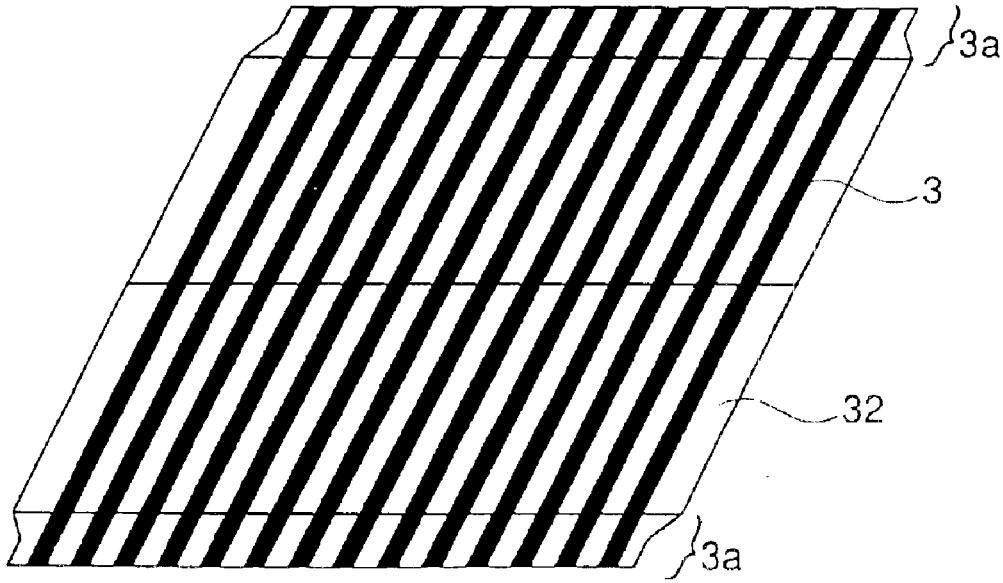

FIGS. 4(*a*) and 4(*b*) are explanatory views illustrating an electrode structure on the front substrate 31 and one on the rear substrate 32.

As mentioned above, one connector-connecting portion 2*a* for one electrode of the display electrode pair 2 is provided at the right edge of the front substrate 31 and the other connector-connecting portion 2*a* for the other electrode is provided at the left edge. These connector-connecting portions 2*a* are capable of being connected to display electrode connectors, to which are connected drivers (driving circuits) for applying a voltage to the display electrode pairs 2.

This means that the electrode-extended portions 2*a* are formed into plugs to be inserted into the display electrode connectors. Accordingly, without using flexible wiring cables, the display electrode pairs 2 are capable of being connected to the drivers, so that cost reduction can be achieved.

Also, the connector-connecting portions 3*a* for the data electrodes 3 are provided at the top and bottom edges of the rear substrate 32. These connector-connecting portions 3*a* are capable of being connected to the data electrode connectors, to which are connected drivers for applying the voltage to the data electrodes 3.

This means that the electrode-extended portions 3*a* are formed into plugs to be inserted into the data electrode connectors.

The data electrode 3 is divided into upper and lower sections. Therefore, the voltage is applied from the connector-connecting portion 3*a* provided at the top edge to the data electrodes 3 for emission points in the upper half section of the tube 1, and it is applied from the connector-connecting portion 3*a* provided at the bottom edge to the data electrodes 3 for emission points in the lower half section of the tube 1.

Figure 5:
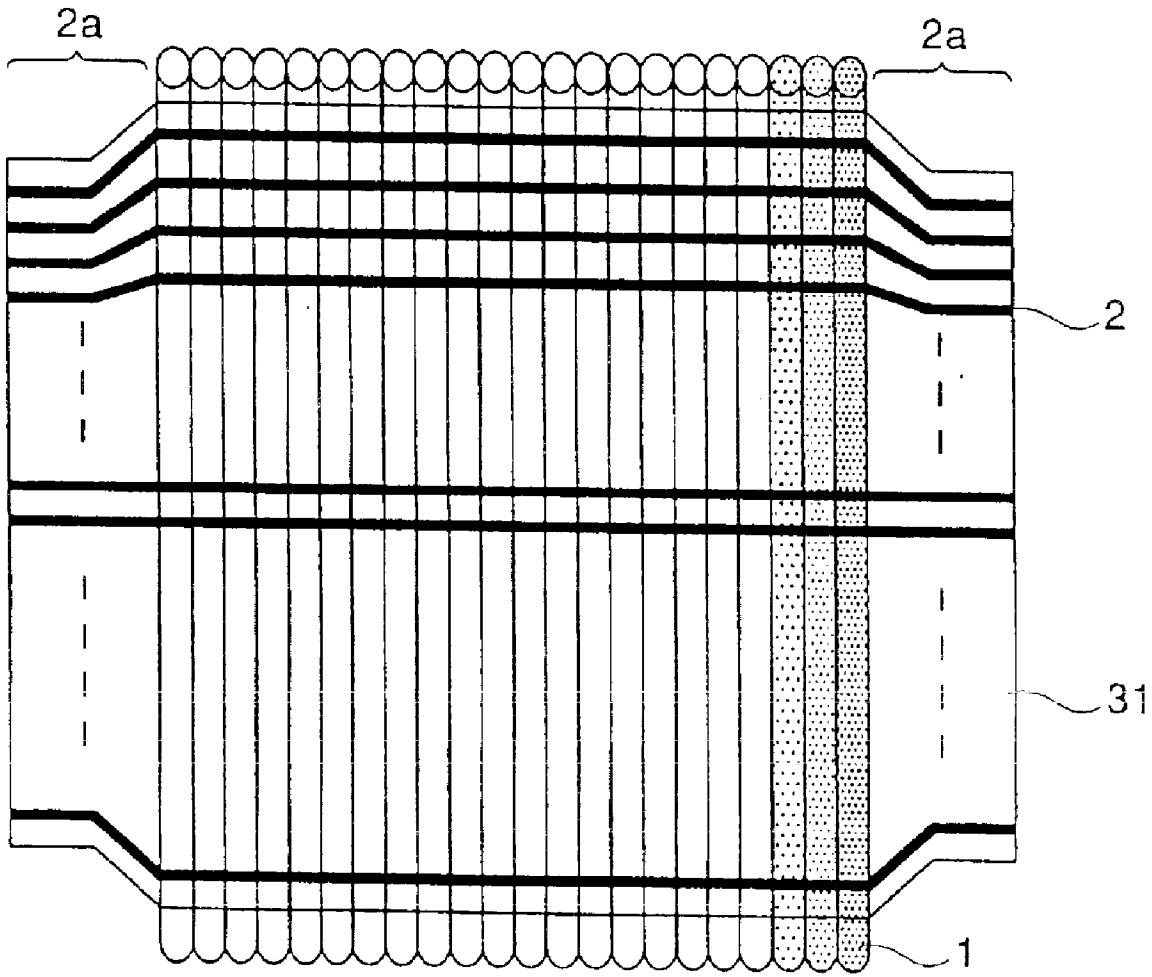
FIG. 5 is an explanatory view illustrating an example of the shape of the connector-connecting portions for the display electrode pairs of the display device as an embodiment.

FIG. 5 is an explanatory view illustrating an example of the shape of the connector-connecting portions for the display electrode pairs.

In this example, each connector-connecting portion 2*a* for the display electrode pairs 2, provided at the right and left edges of the front substrate 31, is not divided and connected as one to the display electrode connector.

Figure 6:
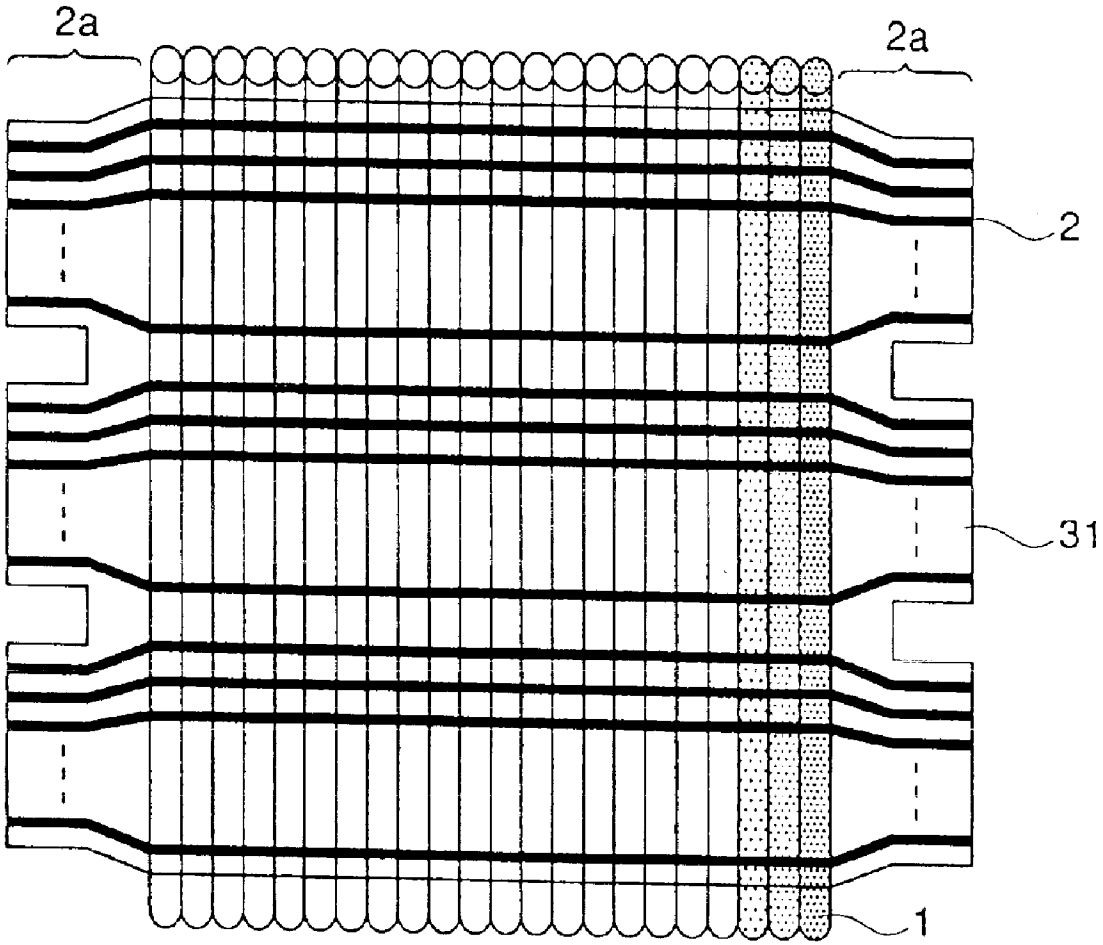
FIG. 6 is an explanatory view illustrating another example of the shape of the connector-connecting portions for the display electrode pairs of the display device as an embodiment.

FIG. 6 is an explanatory view illustrating another example of the shape of the connector-connecting portions for the display electrode pairs.

In this example, each connector-connecting portion 2*a* for the display electrode pairs 2, provided at the right and left edges of the front substrate 31, is divided by notches into a plurality of sections as shown in FIG. 6, to be connected to the display electrode connectors.

The division of the connector-connecting portion 2*a* into the plurality of sections for use of a plurality of drivers of one kind having a predetermined size allows the constitution of the display device to be easily adapted to screen size changes. Also; reductions in cost of the drivers can be achieved.

Figure 7:
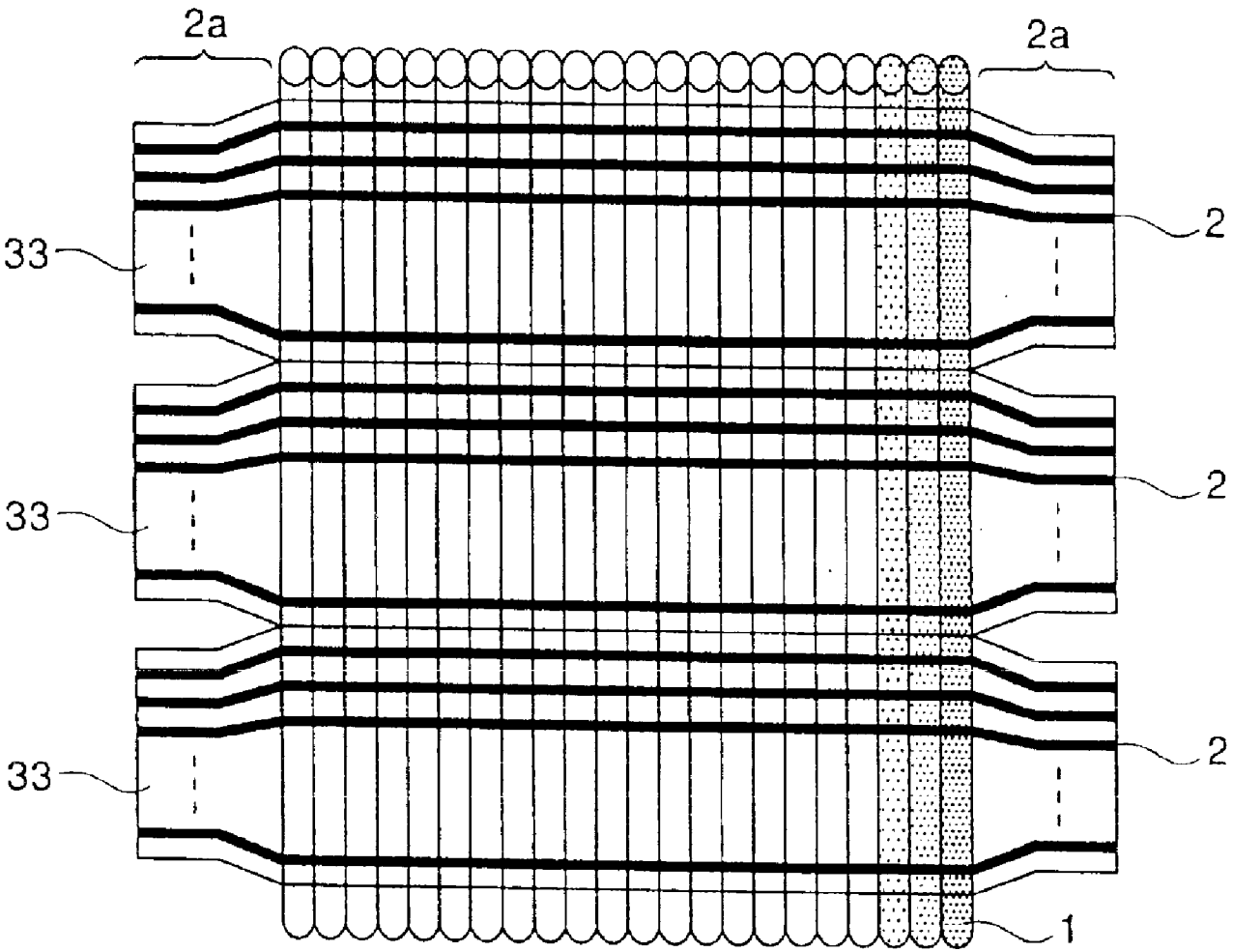
FIG. 7 is an explanatory view illustrating still another example of the shape of the connector-connecting portions for the display electrode pairs of the display device as an embodiment.

FIG. 7 is an explanatory view illustrating still another example of the shape of the connector-connecting portions for the display electrode pairs.

In this example, the front substrate 31 is composed of a plurality of substrates 33 of the same size. The single substrate 33 is a fraction to one-tenths as large as a display screen. Each connector-connecting portion 2*a* for the display electrode pairs 2, provided at the right and left edges of the substrate 33, is divided into the plurality of sections to be connected to the display electrode connectors.

The plurality of substrates 33 to provide the plurality of connector-connecting portions 2*a* for the plurality of drivers of one kind having a predetermined size allows the constitution of the display device to be easily adapted to screen size changes, since they are dealt with only by one kind of the substrates 33 and the drivers. Also, reductions in cost of the drivers can be achieved.

Figure 8:
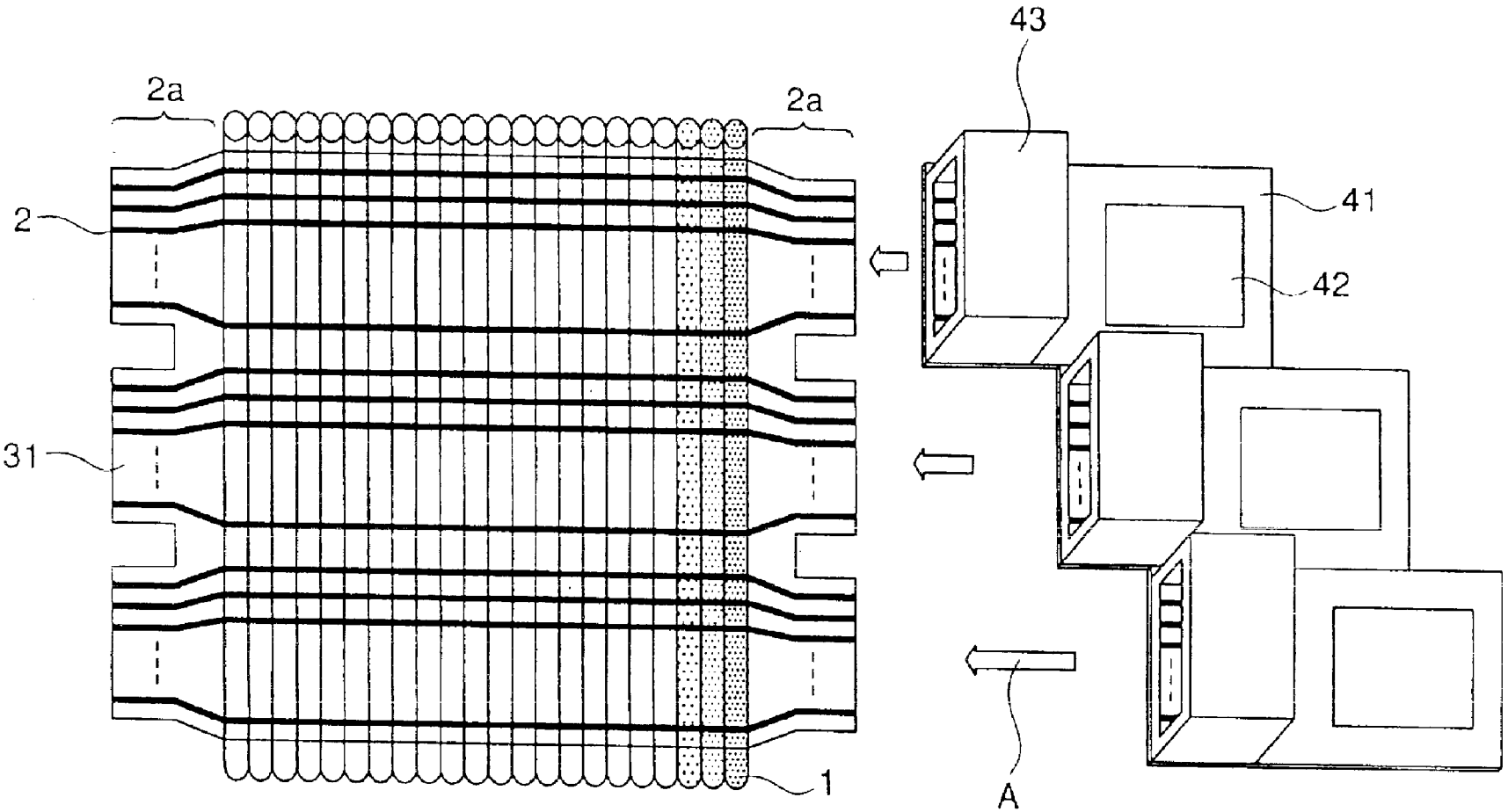
FIG. 8 is an explanatory view illustrating an example of connecting the connector-connecting portions for the display electrodes and the display electrode connectors to each other of the display device as an embodiment.

FIG. 8 is an explanatory view illustrating an example of connecting the connector-connecting portions for the display electrodes and the display electrode connectors to each other.

In this drawing, the numeral reference 41 denotes driver substrates, 42 driver ICs that the driver substrates 41 has, and 43 the display electrode connectors. One terminal of the driver IC 42 is connected via wiring of the driver substrate 41 to the display electrode connector 43. The driver substrate 41, the driver IC 42 and the display electrode connector 43 are intended for either electrode of the display electrode pair 2.

The plurality of connector-connecting portions 2*a* for the display electrode pairs 2 are inserted into the corresponding display electrode connectors 43 as shown by arrow A in FIG. 8, thereby to be connected to the driver ICs 42. The relationship between the connector-connecting portion 2*a* and the display electrode connector 43 is that between a plug and a socket, wherein the former is made easily detachable from the latter at any time.

Figure 9:
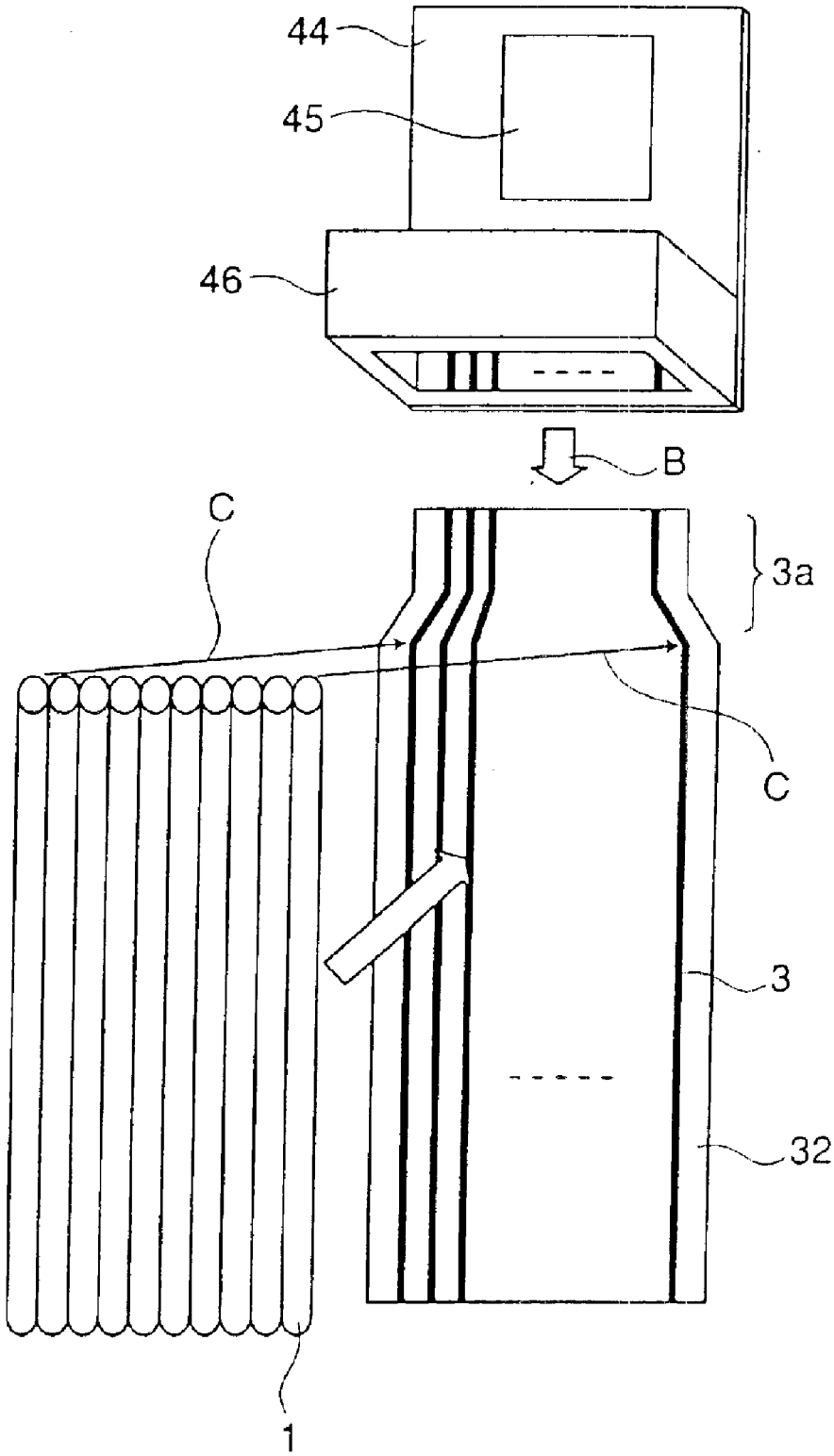
FIG. 9 is an explanatory view illustrating another example of connecting the connector-connecting portions for the data electrodes and the data electrode connectors to each other of the display device as an embodiment.

FIG. 9 is an explanatory view illustrating another example of connecting the connector-connecting portions for the data electrodes and the data electrode connectors to each other.

In this drawing, the numeral reference 44 denotes a driver substrate, 45 a driver IC that the driver substrate 45 has, 46 a data electrode connector. One terminal of the driver IC is connected via wiring of the driver substrate 44 to the data electrode connector 46. The driver substrate 44, the driver IC 45 and the data electrode connector 46 are intended for the data electrode provided at either the upper or lower edge of the rear substrate 32.

The data electrodes 3 are formed on the tube-facing surface of the rear substrate 32 in the longitudinal direction of the tubes 1. The tubes 1 are arranged on the rear substrate 32 so that the tubes 1 and the data electrodes 3 come into contact with each other in one-to-one correspondence as shown by arrow C in FIG. 9.

The connector-connecting portion 3*a* for the data electrodes 3 is formed into a plug to be inserted into the data electrode connector 46, as shown by arrow B in FIG. 9, thereby to be connected to the driver IC 45. The relationship connector-connecting portion 3*a* and the data electrode connector 46 is that between a plug and a socket, wherein the former is made easily detachable from the latter at any time. Therefore, without using flexible wiring cables, the data electrodes 3 are capable of being connected to the driver, so that cost reduction can be achieved.

Figure 10:
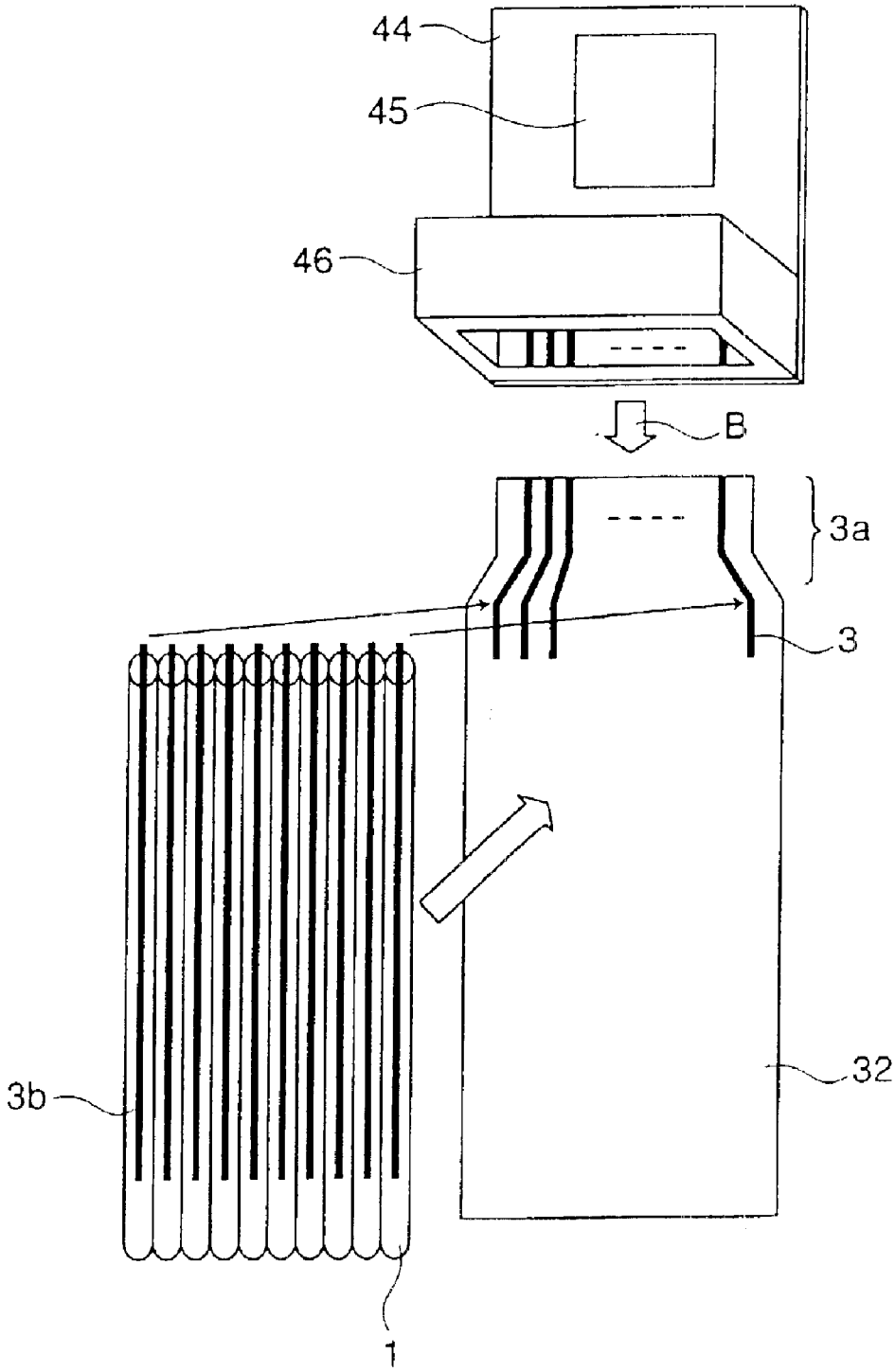
FIG. 10 is an explanatory view illustrating another example of the data electrodes and the rear substrate of the display device as an embodiment.

FIG. 10 is an explanatory view illustrating another example of the data electrodes and the rear substrate.

In this example, data electrode films 3*b* are formed on the tubes 1 by printing or depositing, and the data electrodes 3 are provided on the rear substrate 32 only at the electrode-extended portion 3*a* and its adjacent areas.

The tubes 1 are arranged on the rear substrate 32 so that the data electrode films 3*b* of the tubes 1 and the data electrodes 3 come into contact with each other in one-to-one correspondence.

The connector-connecting portion 3*a* for the data electrodes 3 and the data electrode connector 46 are connected as in the example of FIG. 9.

Figure 11:
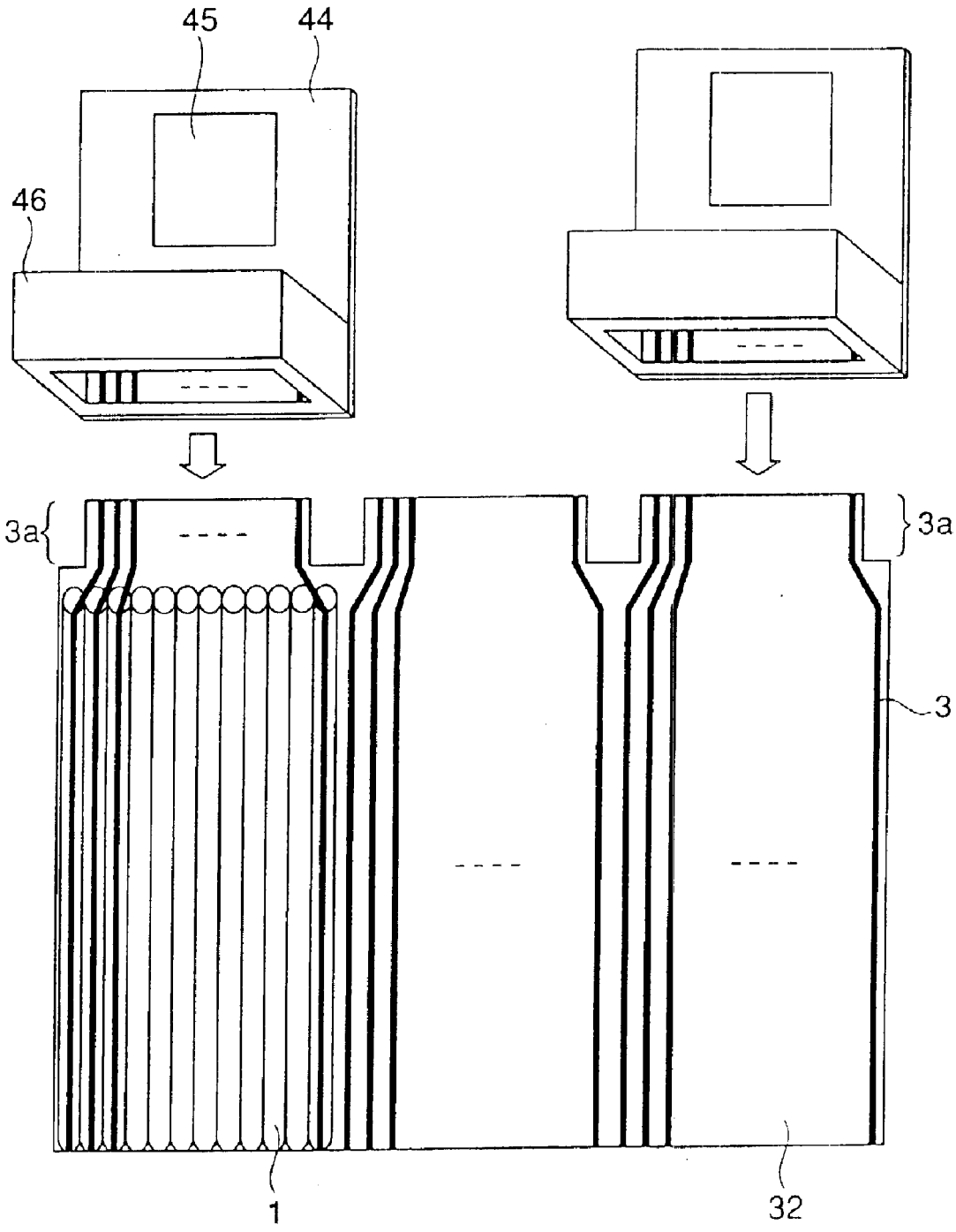
FIG. 11 is an explanatory view illustrating a shape of the connector-connecting portion for the data electrodes divided into a plurality of sections in the display device as an embodiment.

FIG. 11 is an explanatory view illustrating a shape of the connector-connecting portion for the data electrodes that is divided into a plurality of sections.

In this example, the connector-connecting portion 3*a* for the data electrodes 3 is divided into the plurality of sections to be connected to the data electrode connectors 46.

The division of the connector-connecting portion 3*a* into the plurality of sections for use of a plurality of drivers of one kind having a predetermined size allows the constitution of the display device to be easily adapted to screen size changes. Also, reductions in cost of the drivers can be achieved.

The division of the connector-connecting portion 3*a* into the plurality of sections can be also applied to the rear substrate 32 having an electrode structure as shown in FIG. 10.

Figure 12:
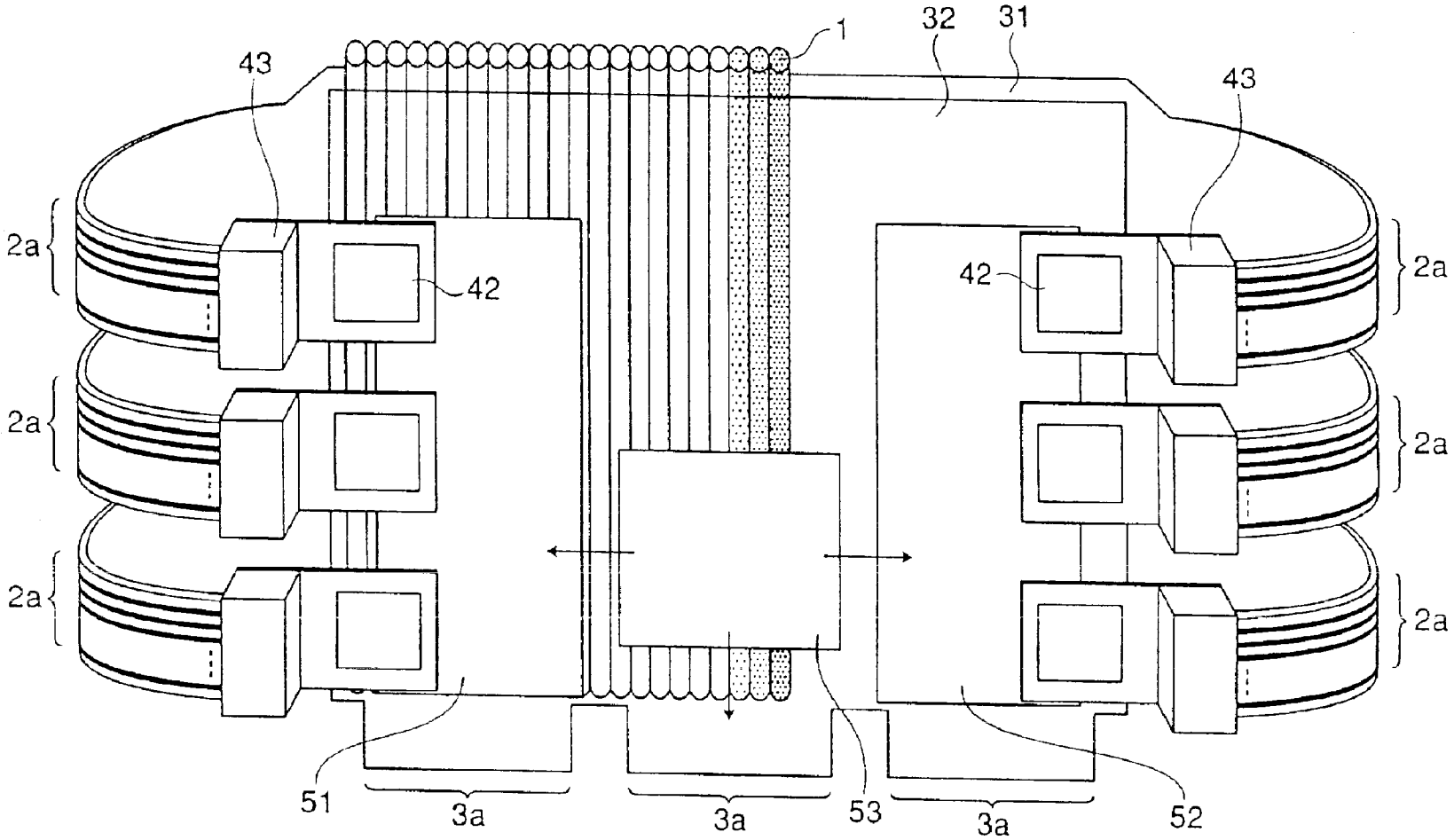
FIG. 12 is an explanatory view illustrating an electric circuit provided on a back side of the display device as an embodiment.

FIG. 12 is an explanatory view illustrating an electric circuit provided on a back side of the display device.

The electric circuit provided on the back side of the display device includes a plurality of driver ICs and a control circuits for controlling the driver ICs. In this drawing, numeral reference 51 indicates a first driver substrate, 52 a second driver substrate and 53 a control circuit substrate.

The plurality of driver ICs 42 for one electrode of the display electrode pair are provided on the first driver substrate 51. The plurality of driver ICs 42 for the other electrode of the display electrode pair are provided on the second driver substrate 52. The control circuit for controlling a first driver circuit and a second driver circuit is provided on the control circuit substrate 53.

A plurality of display electrode connectors 43 are connected to the corresponding driver ICs 42, respectively.

Each connector-connecting portion 2*a* for the display electrode pairs 2, provided at the right and left edges of the front substrate 31, is divided into a plurality of sections and gently curved from a front side of the display device to the back side thereof to be connected to the display electrode connectors 43.

The connector-connecting portion 3*a* for the data electrodes, provided at the bottom edge of the rear substrate 32, is divided into a plurality of sections to be connected to the data electrode connectors 43.

As mentioned above, the connector-connecting portions are provided both at the right and left edges of the front substrate and at the top and bottom edges of the rear substrate with a tube array interposed between the front and rear substrates. As a result, without using conventional flexible wiring cables, the electrodes are capable of being easily connected to the drivers, so that cost reduction can be achieved.

According to the present invention, the supporter for supporting the emitting tubes has at the edge the connecting portion to be detachably connected to the connector for applying the voltage to the plurality of electrodes, so that it becomes possible to eliminate the need for using conventional wiring cables to facilitate connection between the electrodes and the drivers, with a result that connection costs can be reduced.

What is claimed is:

1. A display device comprising:

a plurality of emitting tubes constituted by elongated tubes each having a phosphor layer disposed and a discharge gas enclosed inside;

a supporter for supporting the plurality of emitting tubes while making contact therewith, the supporter having an edge; and a plurality of electrodes disposed on a surface of the supporter facing the emitting tubes for generation of electric discharges within the emitting tubes, wherein the edge of the supporter is formed as a connecting portion having a shape adapted to be detachably connected to a connector for applying a voltage to the plurality of electrodes, the plurality of electrodes extending to the connecting portion.

2. The display device of claim 1, wherein the supporter comprises a pair of supporters for supporting the plurality of emitting tubes on a display side and on a rear side of the display device.

3. The display device of claim 2, wherein at least a supporter of the supporter pair on the display side is made of flexible film sheet.

4. The display device of claim 1, wherein the connecting portion is formed into a plug to be inserted into the connector.

5. The display device of claim 1, wherein the connecting portion is divided into a plurality of sections.

6. The display device of claim 3, wherein the supporter at the display side is divided into a plurality of pieces that have at edges connecting portions, respectively.

7. The display device of claim 5, wherein the connector comprises a plurality of connectors corresponding to the divided connecting portion.

8. The display device of claim 6, wherein the connector comprises a plurality of connectors corresponding to the plurality of connecting portions that are connected to drive circuits for applying the voltage to the plurality of electrodes.

9. The display device of claim 8, wherein the plurality of connectors are provided on the rear side of the display device, and the divided connecting portion is gently curved to be connected to the plurality of connectors.

10. The display device of claim 2, wherein the connecting portion is divided into a plurality of sections.

11. The display device of claim 10, wherein the connector comprises a plurality of connectors corresponding to the divided connecting portion.

12. A display device comprising:

a plurality of emitting tubes constituted by elongated tubes each having a phosphor layer disposed and a discharge gas enclosed inside;

a supporter for supporting the plurality of emitting tubes while making contact therewith, the supporter having a connecting portion at an edge; and a plurality of electrodes disposed on a surface of the supporter facing the emitting tubes for generation of electric discharges within the emitting tubes, wherein the connecting portion of the supporter is detachably connected to a connector for applying a voltage to the plurality of electrodes, the supporter comprises a pair of supporters for supporting the plurality of emitting tubes on a display side and on a rear side of the display device, and at least a supporter of the supporter pair on the display side is made of flexible film sheet.

13. The display device of claim 12, wherein the supporter at the display side is divided into a plurality of pieces that have at edges connecting portions, respectively.

14. The display device of claim 13, wherein the connector comprises a plurality of connectors corresponding to the plurality of connecting portions that are connected to drive circuits for applying the voltage to the plurality of electrodes.

15. The display device of claim 14, wherein the plurality of connectors are provided on the rear side of the display device, and the divided connecting portion is gently curved to be connected to the plurality of connectors.

16. A display device comprising:

elongated emitting tubes each having a phosphor layer disposed and a discharge gas enclosed inside;

a supporter supporting the emitting tubes while making contact therewith, the supporter having an edge; and electrodes disposed on a surface of the supporter facing the emitting tubes to generate electric discharges within the emitting tubes, wherein the edge of the supporter is formed as a connecting portion having a shape adapted to be detachably connected to a connector to apply a voltage to the electrodes, and the electrodes extend to the connecting portion.

* * * * *